US007823254B2

(12) United States Patent
Lin

(10) Patent No.: US 7,823,254 B2
(45) Date of Patent: Nov. 2, 2010

(54) HINGE ASSEMBLY

(75) Inventor: Chao-Chi Lin, Taichung (TW)

(73) Assignee: Leohab Enterprise Co.,Ltd., Taichung (TW)

( * ) Notice: Subject to any disclaimer, the term of this patent is extended or adjusted under 35 U.S.C. 154(b) by 392 days.

(21) Appl. No.: 12/031,781

(22) Filed: Feb. 15, 2008

(65) Prior Publication Data

US 2009/0205170 A1 Aug. 20, 2009

(51) Int. Cl.
*E05C 17/64* (2006.01)

(52) U.S. Cl. ..... 16/337; 16/330; 16/340

(58) Field of Classification Search ..... 16/337–339, 16/342, 330, 374, 376, 377, 340, 303; 361/679.11, 361/679.12, 679.27; 455/90.3, 575.1, 575.3, 455/575.8; 379/433.12, 433.13; 348/373, 348/333.01, 333.06, 794
See application file for complete search history.

(56) References Cited

U.S. PATENT DOCUMENTS 1,987,060 A * 1/1935 Hammond ..... 16/340
6,108,868 A * 8/2000 Lin ..... 16/340
6,421,878 B1 * 7/2002 Kaneko et al. ..... 16/330
7,082,642 B2 * 8/2006 Su ..... 16/340
7,219,393 B2 * 5/2007 Kida ..... 16/221
7,565,719 B2 * 7/2009 Su ..... 16/337
2005/0066475 A1 * 3/2005 Minami ..... 16/337
2007/0174996 A1 * 8/2007 Lu et al. ..... 16/340

FOREIGN PATENT DOCUMENTS

TW M556861 10/2003

* cited by examiner

*Primary Examiner*—Chuck Y. Mah
(74) *Attorney, Agent, or Firm*—Alan Kamrath; Kamrath & Associates PA

(57) ABSTRACT

A hinge assembly suitable for coupling a notebook computer base to a display includes a first coupling member for coupling to the base and a second coupling member for coupling to the display. A positioning device supports the display at various angular positions relative to the base. A friction device increases resistance to movement throughout the range of motion of the hinge assembly while decreasing torque and pressure load transmitted to the positioning device.

15 Claims, 7 Drawing Sheets

HINGE ASSEMBLY

BACKGROUND OF THE INVENTION

1. Field of the Invention

The present invention relates to a hinge assembly and, in particular, to a hinge assembly for electronic apparatus.

2. Description of the Related Art

Referring to Taiwan Patent Publication No. 556,861, there is disclosed a hinge mechanism for supporting a display at various angular positions relative to a base. The hinge mechanism includes a first coupling member 10 for coupling to the base, a second coupling member 20 for coupling to the display, and two resilient members 30 disposed oppositely and frictionally rotatable with respect to a wall of the second coupling member 20 for supporting the display at various angular positions with respect to the base. However, a problem with such hinge mechanism is that torque and pressure load transmitted to the resilient members 30 can break the resilient members 30 easily.

The present invention is, therefore, intended to obviate or at least alleviate the problems encountered in the prior art.

SUMMARY OF THE INVENTION

It is therefore an object of the present invention to provide a hinge assembly that increases life of components and that is used for supporting a display at various angular positions relative to a base.

Accordingly, the object is achieved by providing a hinge assembly that includes a first coupling member for coupling to the base and a second coupling member for coupling to the display. A positioning device supports the display at various angular positions relative to the base. A friction device increases resistance to movement throughout the range of motion of the hinge assembly while decreasing torque and pressure load transmitted to the positioning device. A biasing member imparts biasing force to the positioning device and the friction device, and a plurality of lubricating washers lubricates the friction device.

There has thus been outlined, rather broadly, the more important features of the invention in order that the detailed description thereof that follows may be better understood and in order that the present contribution to the art may be better appreciated. There are additional features of the invention that will be described hereinafter and which will form the subject matter of the claims appended hereto.

DETAILED DESCRIPTION OF THE PREFERRED EMBODIMENT

Figure 1:
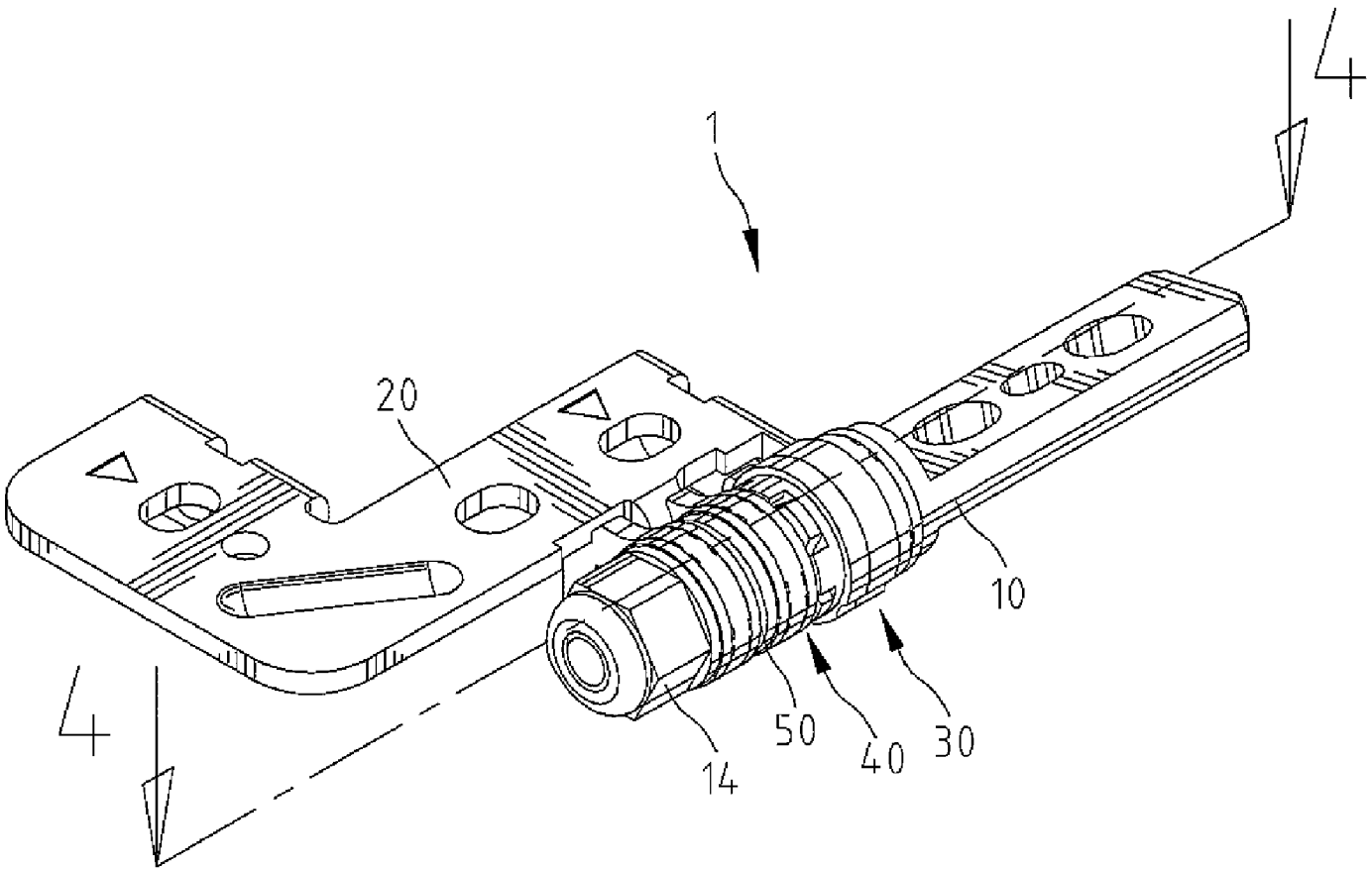
FIG. 1 is a perspective view of a hinge assembly in accordance with a first embodiment of the present invention.
Figure 2:
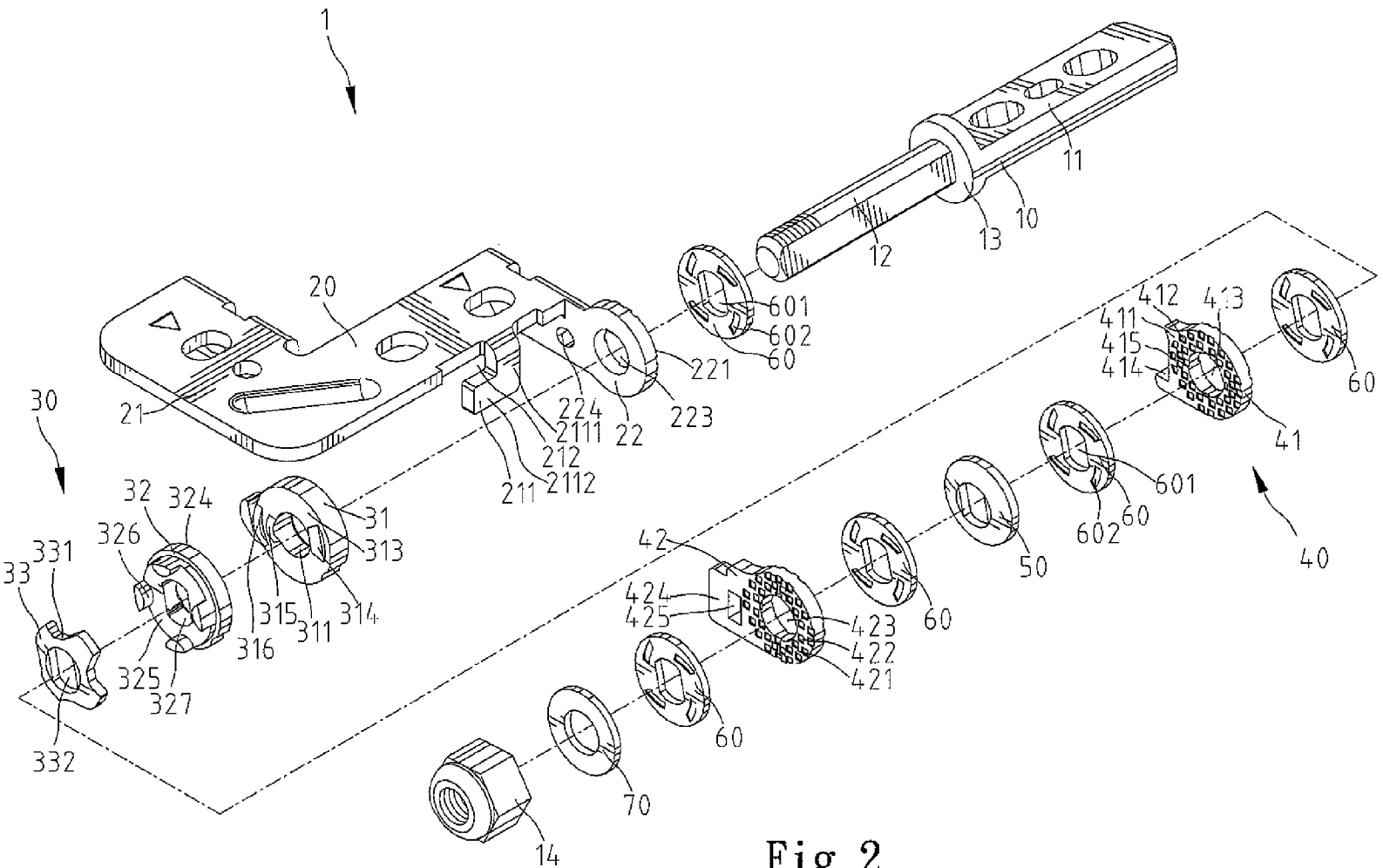
FIG. 2 is an exploded perspective view of the hinge assembly of FIG. 1.
Figure 3:
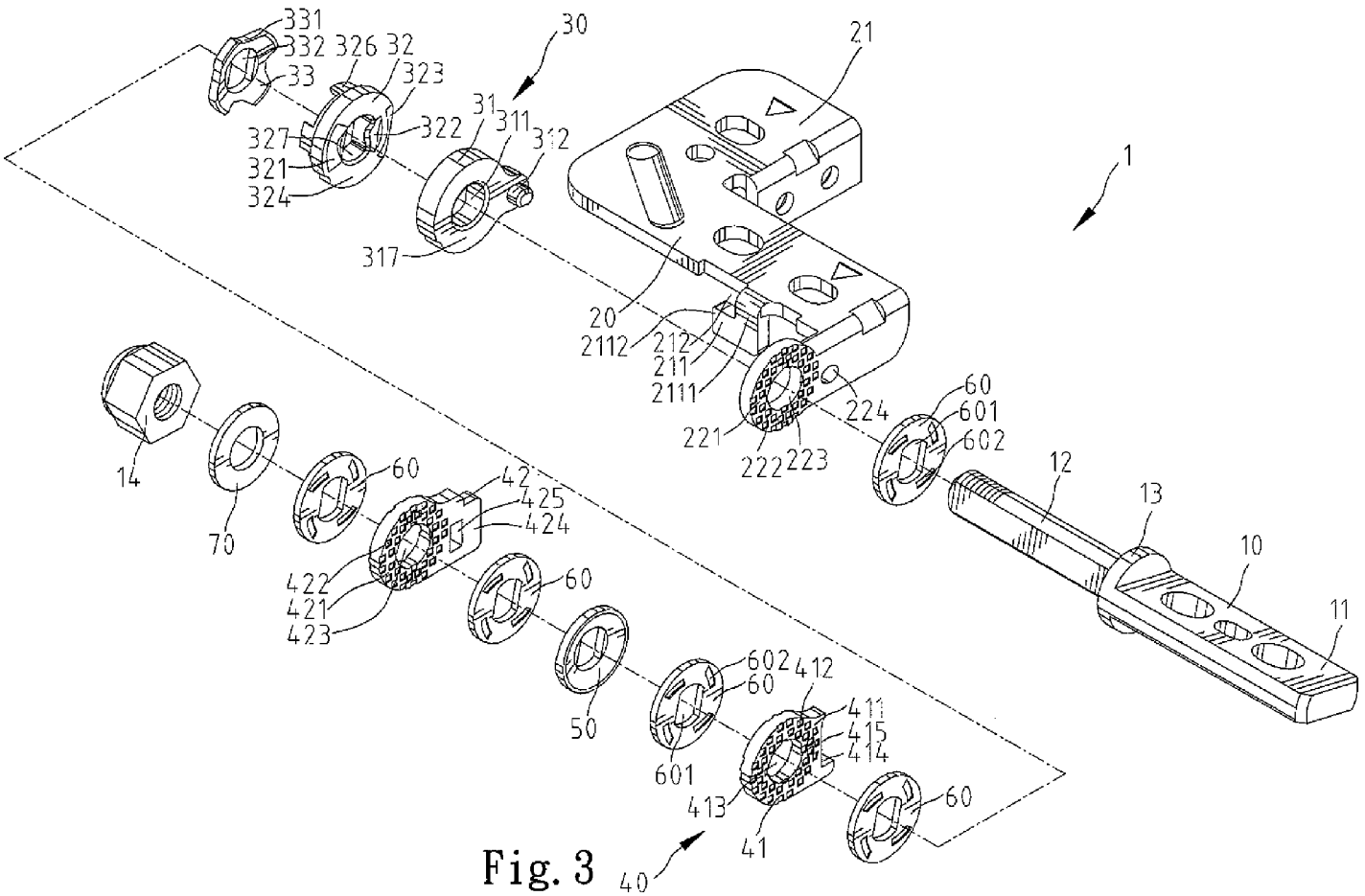
FIG. 3 is an exploded perspective view of the hinge assembly of FIG. 1 taken from a different angle of view.

Referring to FIGS. 1 through 4, a hinge assembly 1 suitable for coupling a notebook computer base to a display includes a first coupling member 10 for coupling to the base, a second coupling member 20 for coupling to the display, a positioning device 30 for supporting the display at various angular positions relative to the base, a friction device 40 for increasing resistance to movement throughout the range of motion of the hinge assembly 1 while decreasing torque and pressure load transmitted to the positioning device 30, a biasing member 50 for imparting biasing force to the positioning device 30 and the friction device 40, and a plurality of lubricating washers 60 for lubricating the friction device 40.

The first coupling member 10 has a first section 1, a second section 12 and a shoulder 13 formed therebetween. The second section 12 pivotally receives the positioning device 30, the friction device 40, the biasing member 50, and the plurality of lubricating washers 60 and threadly engages with an end cap 14 for retaining the aforementioned elements 30, 40, 50, 60 on the second portion 12. Furthermore, a spacer 70 is provided between one of the plurality of lubricating washers 60 and the end cap 14 so as to prevent the end cap 14 from fretting the lubricating washer 60.

The second coupling member 20 includes a connection end 21 and a pivotal end 22 extended from the connection end 21. The pivotal end 22 includes a hole 223 in which the second section 12 of the first coupling member 10 is inserted and can be rotated with respect to the second section 12 of the first coupling member 10. The pivotal end 22 further includes a friction face 221 facing the shoulder 13, and the friction face 221 has a plurality of dents 222 for keeping lubricant. Furthermore, an anchor 211 has a first portion 2111 extended from the connection end 21 and a second portion 2112 extended from the first portion 2111. Since the second portion 2112 is spaced from the connection end 21, a gap 212 is defined between the connection end 21 and the second portion 2112.

The positioning device 30 includes a first detent 31 having a first face 313 and a second face 317 and a hole 311 transversely extending therebetween and that receives the second section 12 of the first coupling member 10 and can be rotated with respect to the second section 12 of the first coupling member 10. The first face 313 has a first ridge 314, a second ridge 315, and a third ridge 316 disposed at different radii from the hole 311, and the second and third ridges 315 and 316 are opposite to the first ridge 314. The second face 317 has a catch 312 extended therefrom and that is received in an orifice 224 so that when the second coupling member 20 rotates, the first detent 31 and the second coupling member 20 can be rotatable together.

The positioning device 30 further includes a second detent 32 having a first face 324, a second face 325 and a hole 327 transversely extending therebetween and that receives the second section 12 of the first coupling member 10 and can be rotated in concert with the second section 12 of the first coupling member 10. The first face 324 has a first indentation 321, a second indentation 322, and a third indentation 323 formed thereon complemently receivable in the first, second, third ridges 314, 315, 316, respectively. The second face 325 has four stubs 326 formed thereon. Furthermore, the positioning device 30 includes a resilient member 33 positioned against the second face 325. The resilient member 33 is formed in a shape of a dome with a predetermined curvature and includes four recessed edges 331 and a hole 332. The four recessed edges 331 correspondingly surround the four stubs 326 of the second face 325 respectively. The hole 332 allows insertion of the second section 12 of the first coupling member 10.

The friction device 40 includes a first friction member 41 having two opposed friction faces 411 and a hole 413 transversely extending therebetween and that receives the second section 12 of the first coupling member 10 and can be rotated with respect to the second section 12 of the first coupling member 10. Each friction face 411 has a plurality of dents 412 for keeping lubricant. In addition, the first friction member 41 includes a protrusion 414 and a space 415 delimiting a portion of the periphery of the first friction member 41 and a portion of the protrusion 414 that slidably receives the second portion 2112 of the anchor 211 of the second coupling member 20.

The friction device 40 further includes a second friction member 42 having two opposed friction faces 421 and a hole 423 transversely extending therebetween and that receives the second section 12 of the first coupling member 10 and can be rotated with respect to the second section 12 of the first coupling member 10. Each friction face 421 has a plurality of dents 422 for keeping lubricant. In addition, the second friction member 42 includes an extension 424 having an orifice 425 extending therethrough and that slidably receives the second portion 2112 of the anchor 211 of the second coupling member 20.

The sliding movement of the first and second friction members 41 and 42 are dependent upon engagement/disengagement of the first, second, and third ridges 314, 315, 316 with the first, second, and third indentations 321, 322, 323, respectively, and the biasing member 50 is suitable for urging the second detent 32 towards the first detent 31.

Each of the plurality of lubricating washers 60 includes two opposed faces having a plurality of radially disposed recesses 602 for keeping lubricant individually and a hole 601 transversely extending therebetween and that receives the second section 12 of the first coupling member 10. The recesses 602 are each of an arcuate shape so as to achieve ease of movement throughout the range of motion of the hinge assembly.

In this preferred embodiment, two lubricating washers 60 are positioned on the two friction faces 411 of the first friction member 41 respectively, and two lubricating washers 60 are positioned on the two friction faces 421 of the second friction member 42 respectively. One lubricating washer 60 is positioned between the pivotal end 22 of the second coupling member 20 and the shoulder 13 of the first coupling member 10.

Figure 4:
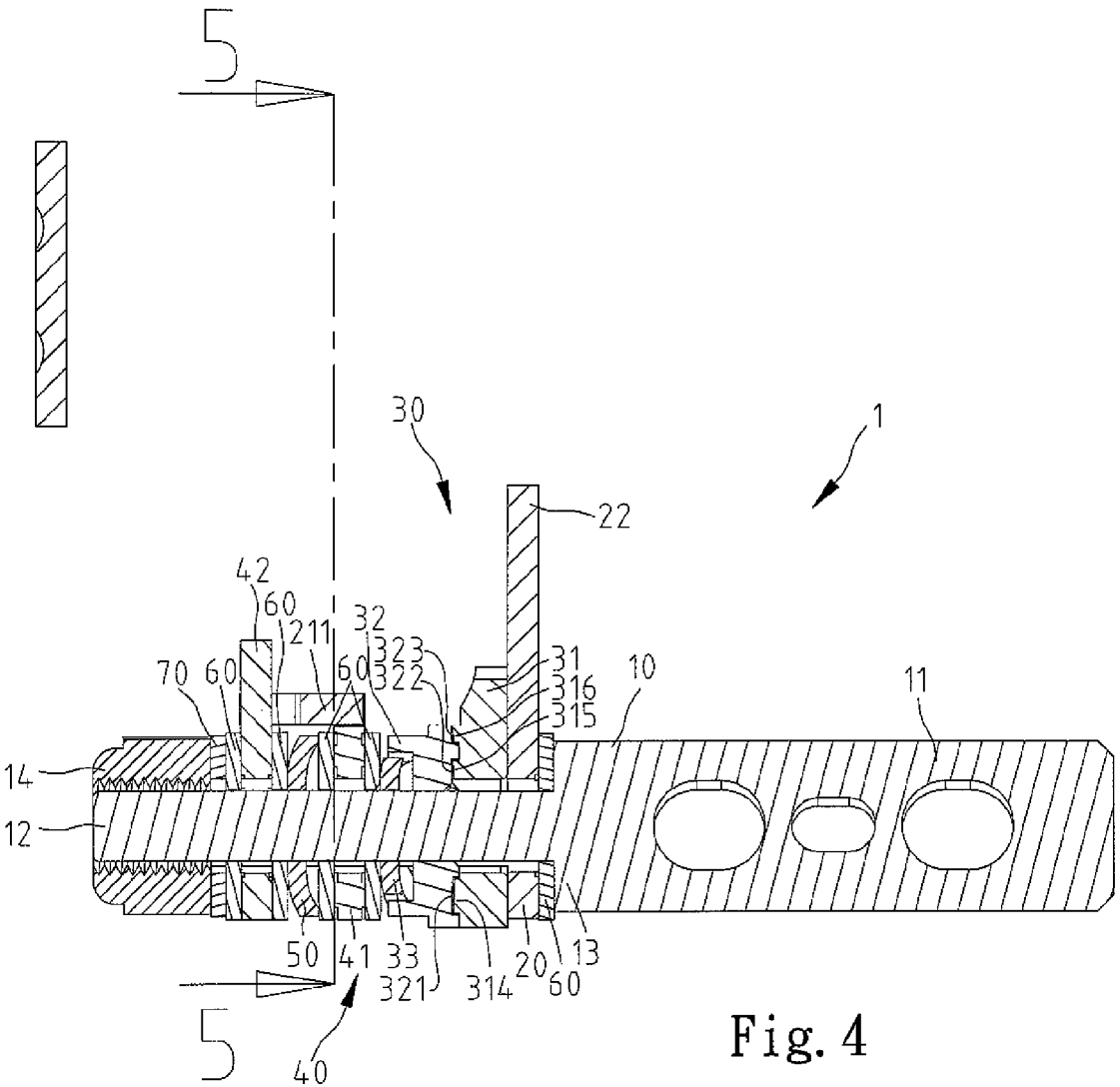
FIG. 4 is a cross-sectional view taken along line 4-4 of FIG. 1.
Figure 5:
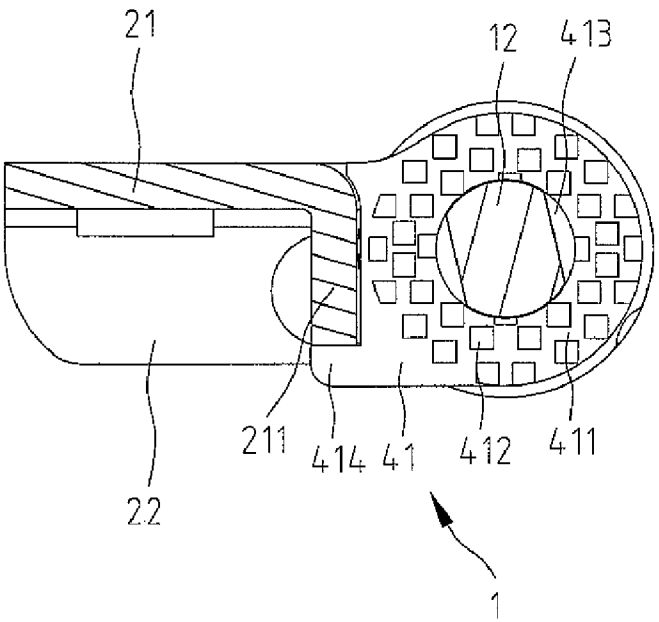
FIG. 5 is a cross-sectional view taken along line 5-5 of FIG. 4.

Referring to FIGS. 4 and 5, when the hinge assembly is in a closed state, the first, second, and third ridges 314, 315, 316 of the first detent 31 are completely received in the first, second, and third indentations 321, 322, 323 of the second detent 32, respectively.

Figure 8:
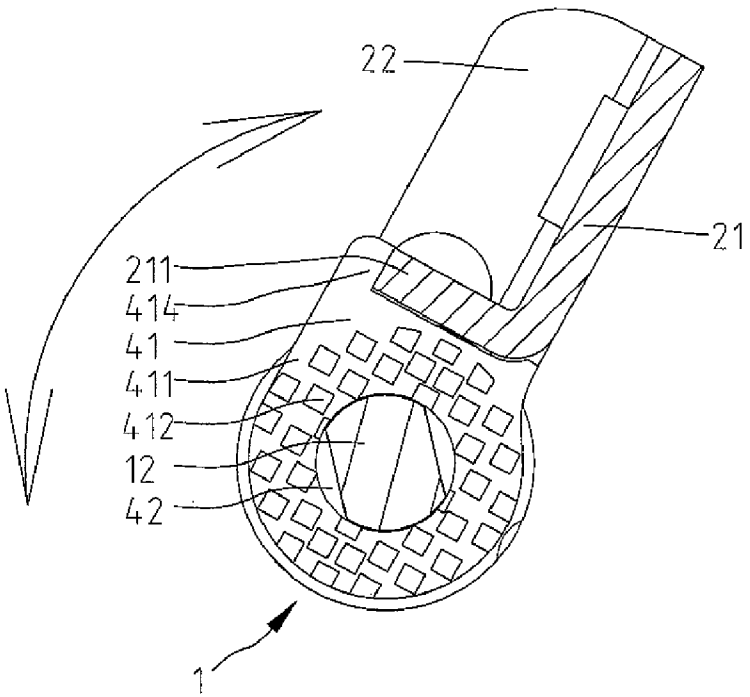
FIG. 8 is similar to FIG. 5, but shows the hinge assembly in another position.
Figure 6:
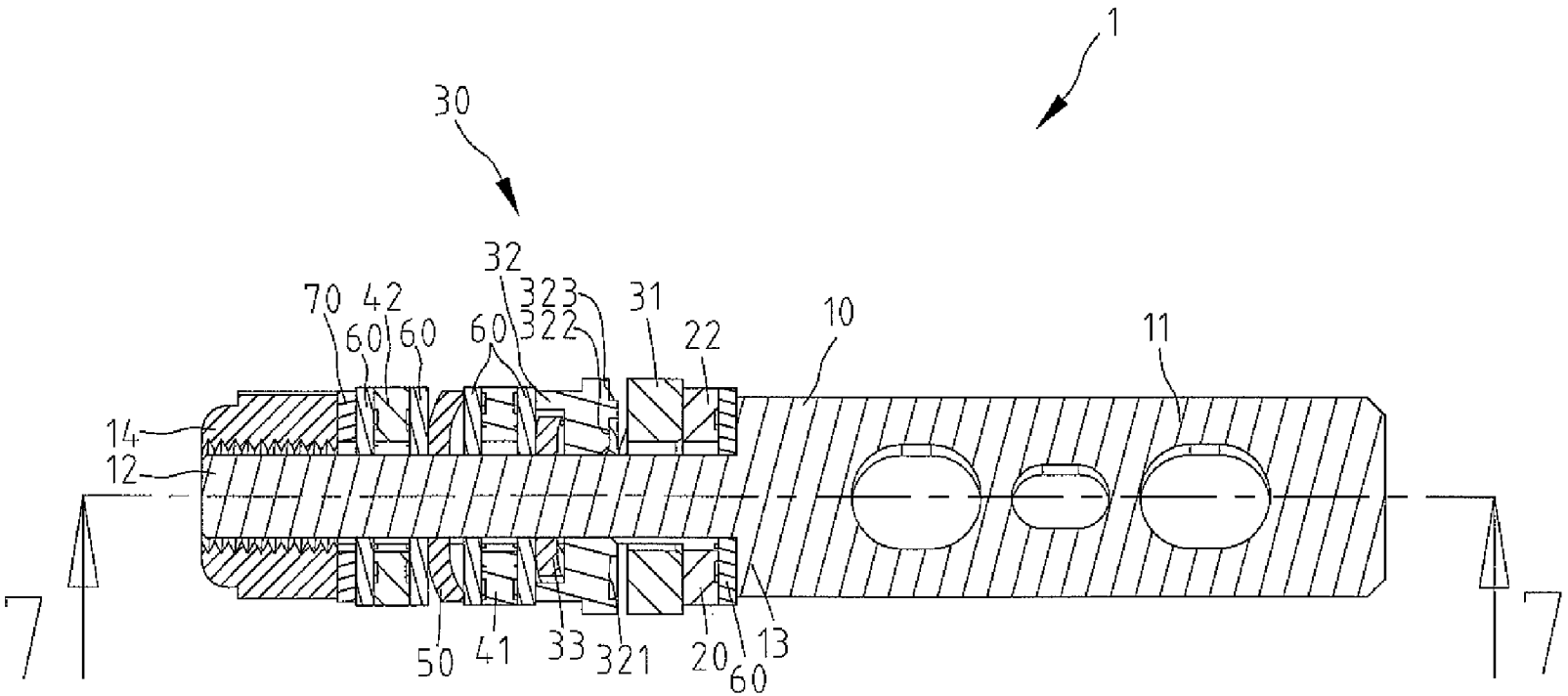
FIG. 6 is similar to FIG. 4, but shows the hinge assembly in another position.
Figure 7:
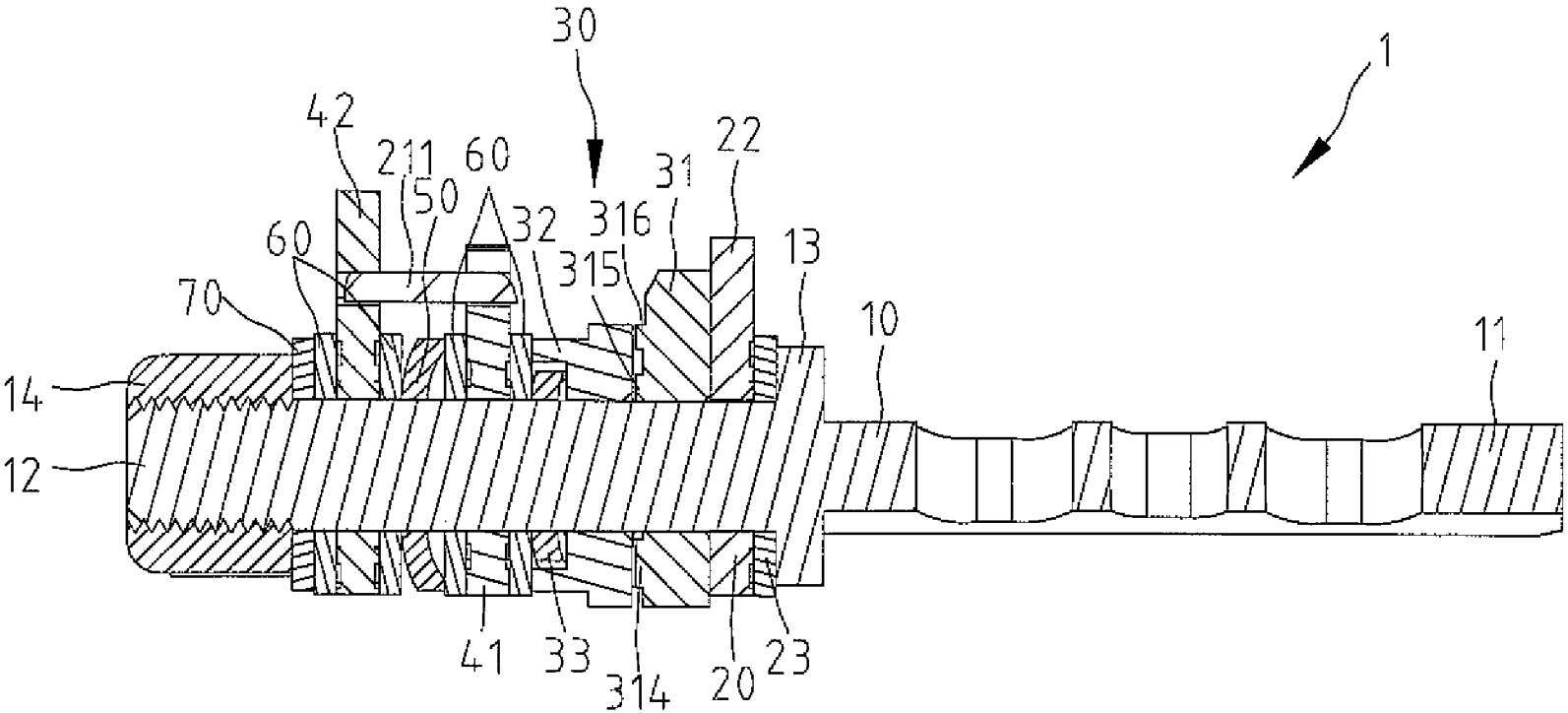
FIG. 7 is a cross-sectional view taken along line 7-7 of FIG. 6

Referring to FIGS. 6 through 8, when gradually opening the hinge assembly, the second coupling member 20 is rotated relative to the first coupling member 10. The first, second, and third ridges 314, 315, 316 of the first detent 31 are gradually rotated to disengage from the first, second, and third indentations 321, 322, 323 of the second detent 32, respectively, The first and second friction members 41 and 42 are rotated relative to the lubricating washers 60 so as to increase resistance to movement throughout the range of motion of the hinge assembly 1 and are slidably moved along the second portion 2112 of the anchor 211 of the second coupling member 20 so as to decrease torque and pressure load transmitted to the positioning device 30.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A hinge assembly comprising:

a first coupling member including a first section and a second section;

a second coupling member pivotally connected to the second section of the first coupling member and including an anchor extended therefrom;

a positioning device connected to the second section of the first coupling member, with the positioning device including a first detent pivotal with respect to the first coupling member, a second detent rotatable in concert with the first coupling member and a resilient member, with the first detent including at least one ridge formed on a first face, with the second detent including at least one indentation formed on a first face corresponding to the at least one ridge respectively, with the resilient member being formed in a shape of a dome with a predetermined curvature positioned on a second surface of the second detent;

a friction device pivotally connected to the second section of the first coupling member and including a first friction member and a second friction member both slidably engaged with the anchor; and a biasing member connected to the second section of the first coupling member and imparting a biasing force to the positioning device and the friction device;

wherein the second coupling member is rotatable with respect to the first coupling member;

wherein the second detent is rotatable with respect to the first detent and the at least one ridge is selectively engagable with the at least one indentation respectively in order to position the second coupling member at a pivot angle with respect to the first coupling member;

wherein the first and second friction members are moved to provide friction to relative movement of the first and second coupling members; and wherein sliding movement of the friction device is dependent upon engagement and disengagement of the at least one ridge with the at least one indentation respectively.

2. The hinge assembly as claimed in claim 1 wherein the anchor comprises a first portion extended from the second coupling member and a second portion extended from the first portion and spaced from the second coupling member.

3. The hinge assembly as claimed in claim 2 wherein the first friction member comprises a protrusion and a space delimiting a portion of a periphery of the first friction member and a portion of the protrusion for receiving the second portion of the anchor.

4. The hinge assembly as claimed in claim 2 wherein the second friction member comprises an extension having an orifice for receiving the second portion of the anchor.

5. The hinge assembly as claimed in claim 1 wherein the first and second friction members comprise two opposed friction faces individually, wherein each opposed friction face includes a plurality of dents formed thereon.

6. The hinge assembly as claimed in claim 5 wherein the first friction member comprises a protrusion and a space delimiting a portion of a periphery of the first friction member and a portion of the protrusion for receiving the second portion of the anchor.

7. The hinge assembly as claimed in claim 5 wherein the second friction member comprises an extension having an orifice for receiving the second portion of the anchor.

8. The hinge assembly as claimed in claim 1 further comprising a plurality of lubricating washers pivotally connected to the second section of the first coupling member, wherein each lubricating washer includes two opposed faces having a plurality of recesses.

9. The hinge assembly as claimed in claim 8 wherein each of the plurality of recesses is of an arcuate shape.

10. The hinge assembly as claimed in claim 1 wherein the first coupling member comprises a shoulder formed between the first and second sections.

11. The hinge assembly as claimed in claim 10 wherein the second coupling member comprises a pivotal end having a hole in which the second section of the first coupling member is inserted and a friction face facing the shoulder.

12. The hinge assembly as claimed in claim 11 wherein the friction face comprises a plurality of dents formed thereon.

13. The hinge assembly as claimed in claim 9 wherein the first friction member is positioned between two of the plurality of lubricating washers, and wherein the second friction member is positioned between another two of the plurality of lubricating washers.

14. The hinge assembly as claimed in claim 9 wherein the first coupling member comprises a shoulder formed between the first and second sections, and wherein the second coupling member comprises a pivotal end having a hole in which the second section of the first coupling member is inserted and a friction face facing the shoulder.

15. The hinge assembly as claimed in claim 14 wherein one of the plurality of lubricating washers is positioned between the friction face of the pivotal end and the shoulder.

* * * * *